US005904155A

United States Patent [19]

Bowman

[11] Patent Number: 5,904,155

[45] Date of Patent: May 18, 1999

[54] METHOD FOR REMOVING ORGANIC COATINGS FROM SUBSTRATES

[75] Inventor: Lawrence E. Bowman, Richland, Wash.

[73] Assignee: Battelle Memorial Institute, Richland, Wash.

[21] Appl. No.: 08/873,603

[22] Filed: Jun. 12, 1997

[51] Int. Cl.[6] ..... B08B 3/08

[52] U.S. Cl. ..... 134/2; 134/38

[58] Field of Search ..... 134/2, 38

[56] References Cited

U.S. PATENT DOCUMENTS

| | | | |
|---|---|---|---|
| 3,355,385 | 11/1967 | Mackley | 134/2 |
| 4,439,241 | 3/1984 | Ault et al. | 134/30 |
| 4,746,369 | 5/1988 | Sullivan et al. | 134/3 |
| 5,215,675 | 6/1993 | Wilkins et al. | 134/3 |
| 5,423,922 | 6/1995 | Kirk | 134/38 |
| 5,542,982 | 8/1996 | Terada et al. | 134/38 |
| 5,578,135 | 11/1996 | Lohr et al. | 134/38 |

OTHER PUBLICATIONS

The alcan Decoater Process For UBC Decoating, B. McAvoy et al., Second International Symposium Recycling of Metals and Engineered Materials, 1990.

A State–of–the–Art UBC Recycling Facility Imsamet's Idaho Plant, J. Wojciechowski et al., Second International Symposium Recycling of Metals and Engineered Materials, 1990.

An Integrated Aluminum Scrap Delacquering and Melting System Meeting Strong Environmental Requirements, W. Trosch, Second International Symposium Recycling of Metals and Engineered Materials, 1990.

Recycling of Lightweight Aluminum Containers: Present and Future Perspectives, RE Sanders et al., Second International Symposium Recycling of Metals and Engineered Materials, 1990.

The Alcan Fluidized Bed Decoater: A New Generation of Decoating Technology, F. Tremblay, et al., Third Internation Symposium Recycling of Metals and Engineered Materials, 1995.

Advanced Technology Delacquering and Melting at Alcan Rolled Products, Oswego, New York, V. Newberry et al., Third Internation Symposium Recycling of Metals and Engineered Materials, 1995.

Recycling of Used Aluminum Beverage Cans in Japan, T. Itou, Third Internation Symposium Recycling of Metals and Engineered Materials, 1995.

*Primary Examiner*—Jill Warden
*Assistant Examiner*—Saeed Chaudhry
*Attorney, Agent, or Firm*—Paul W. Zimmerman

[57] ABSTRACT

The invention is a method of preparing a container for recycling where the container is an inorganic substrate having an organic coating. Preparation is removing the organic coating from the inorganic substrate. The method has the steps of preparing an aqueous solution having a peroxy free-radical and applying the aqueous solution to the container and removing the organic coating.

7 Claims, No Drawings

METHOD FOR REMOVING ORGANIC COATINGS FROM SUBSTRATES

FIELD OF THE INVENTION

The present invention relates generally to a method for removing organic coatings from substrates. More specifically, the invention is for removing exterior paint and ink, and interior protective coating from aluminum beverage cans for recycling same.

BACKGROUND OF THE INVENTION

Because of the high cost of producing aluminum, recycling aluminum products has become a cost effective utilization of aluminum resources. However, recycling has its own challenges, especially with respect to used beverage cans (UBC's). A requirement in recycling UBC's is the removal of exterior surface coating, paint and/or ink, as well as removal of interior surface protective coating that prevents the beverage from contacting the aluminum. The removal of coatings is referred to in the industry as delacquering. The amount of coating on a can varies from about 3 wt % to about 4.5 wt %.

Presently, delacquering is accomplished by heating the UBC's to high temperatures, usually in excess of 500 C. and combusting the organic component of the coating(s). An undesirable concurrent process during delaquering is the conversion of some of the base metal to oxides and hydroxides. Such conversions reduce the yield of metal recovered in the recycling process. In addition, the use of a high temperature furnace is a large component of energy and cost in the recycling process.

Hence, there is a need for a method of removing the exterior paint/ink and the interior protective coating from UBCs that removes the organic component of the coatings but does not appreciably affect the base metal.

SUMMARY OF THE INVENTION

The invention is a method for removing organic coatings from substrates useful for preparing a container for recycling where the container is an inorganic substrate having an organic coating. Preparation is removing the organic coating from the inorganic substrate. The method has the steps of preparing an aqueous solution having a peroxy free-radical and applying the aqueous solution to the container and removing the organic coating.

It is an object of the present invention to provide a method of removing an organic coating from a substrate without substantially altering the substrate.

The subject matter of the present invention is particularly pointed out and distinctly claimed in the concluding portion of this specification. However, both the organization and method of operation, together with further advantages and objects thereof, may best be understood by reference to the following description.

DESCRIPTION OF THE PREFERRED EMBODIMENT(S)

The method of the present invention is removing organic coatings from substrates having a purpose of preparation of a container for recycling, where the container is made of a substrate with an organic coating. The organic coating includes exterior paint/ink used for identification, as well as interior coating preventing the container contents from contacting the substrate. In a preferred embodiment, the substrate is an inorganic material, for example a metal such as an aluminum or aluminum alloy. The method of the present invention has the steps of, comprising the steps of:

(a) preparing an aqueous solution having a peroxy free-radical; and (b) applying the aqueous solution to the container and removing the organic coating.

In a preferred method, applying includes heating. Heating is to a temperature of at least about 100 C. and preferably at least about 200 C. In order to maintain the aqueous solution in a liquid phase, the heating is under pressure. Pressures may be as high as several hundred atmospheres. When the container is an aluminum can, specifically an aluminum beverage can that has only a small opening in the top of the can, the step of applying may further include cutting the aluminum can and providing greater access of the aqueous solution to the interior surfaces.

The peroxy free-radical may be obtained from a peroxide, for example hydrogen peroxide, or tert-butyl peroxide. Hydrogen peroxide is preferred. Alternatively, optical irradiation of molecular oxygen in an organic dye may be used to generate the peroxy free-radical. Further irradiation of water with neutrons also produces the peroxy free-radical.

EXAMPLE 1

A beverage can (Diet Pepsi) was obtained and prepared by cutting sections from the side wall of the can as sample coupons. The sample coupons were washed with distilled deionized water, dried and weighed. A plastic (polytetrafluoroethylene) coated stir bar was placed in the bottom of a sample tube. A few drops of hydrogen peroxide (30%) were put into the sample tube followed by distilled deionized water thereby filling the sample tube and providing a concentration of hydrogen peroxide as shown in TABLE 1. Coupons were placed singly, one at a time, on a fused silica frame, and the fused silica frame with coupon were inserted into the sample tube.

TABLE 1

Sample Coupon Conditions and Results

| Temp (° C.) | Time (hr) Activity | Conc. $H_2O_2$ (wt %) | Organic Removed (wt %) | Comments |
|---|---|---|---|---|
| 200 | 4 static | 3 | 4.0 | paint faded and loosened from surface-easily removed by gentle wiping |
| 200 | 4 static | 0 | 1.2 | no noticeable change, effluent colorless |
| 250[A] | 6 static | 3 | 3.9 | paint almost entirely gone |
| 250 | 7 static | 0 | 1.9 | paint slightly faded |
| 200[B] | 2 stirred | 3 | 3.2 | paint slightly faded |
| 225[B] | 2 stirred | 3 | 3.6 | paint severely faded, polymer liner distorted |
| 250 | 2 stirred | 4.5 | 3.4 | paint severely faded, polymer liner dull |
| 225 | 2 stirred | 4.5 | 3.6 | paint faded, but still legible, polymer liner appeared pitted |

[A]small amount of gelatinous precipitate observed in effluent
[B]polyamide coating on fused silica capillary frame not removed prior to experiment.

A loose fitting cap was placed on the sample tube. The cap was loose fitting to permit escape of vapor from the sample tube. The capped sample tube was placed in an autoclave and distilled deionized water was added to fill the volume between the sample tube and the interior autoclave wall so that the hydrogen peroxide solution would remain within the capped sample tube. The autoclave was sealed, placed on a stir plate, connected to a pressure system, insulated and heated to an operating temperature for a time as shown in TABLE 1. The autoclave was allowed to cool to room temperature and the coupons were collected, rinsed, dried and weighed. It will be apparent to those skilled in the art that the maximum percentage reduction in mass of the processed coupons corresponds to the mass added to a beverage can by its coatings. Accordingly, it is believed that little or no degradation of or material removal from the substrate occurred. Effluent from tests wherein paint was observed to have faded or been removed was slightly yellow. The amount of coating removed was sufficient for the aluminum substrate to meet smelting input specifications.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method of removing an organic coating from a coated inorganic substrate, comprising the steps of:

(a) preparing an aqueous solution having a peroxy free-radical;

(b) applying said aqueous solution at a temperature of at least 100° C. and at a pressure sufficient to maintain the aqueous solution in a liquid phase to said coated substrate and removing said organic coating.

2. The method as recited in claim 1, wherein said pressure is greater than standard atmospheric pressure.

3. The method as recited in claim 1, wherein said inorganic substrate is an aluminum can.

4. The method as recited in claim 3, wherein the step of applying further comprises the step of cutting said aluminum can and providing greater access of said aqueous solution to an interior surface.

5. The method as recited in claim 1, wherein said aqueous solution consists essentially of water and the peroxy free-radical.

6. A method of delacquering an aluminum can, sufficient to meet a smelting specification, the method having the steps of:

(a) cutting the aluminum can into pieces; and (b) exposing the pieces to a delaquering agent;

wherein the improvement comprises:

(i) said delacquering agent is an aqueous solution having a peroxy free-radical heated to a temperature of at least 100° C. at a pressure greater than standard atmospheric pressure.

7. The method as recited in claim 6, wherein said aqueous solution consists essentially of water and the peroxy free-radical.

* * * * *